United States Patent [19]

Turin et al.

[11] Patent Number: 4,930,586

[45] Date of Patent: Jun. 5, 1990

[54] HYDRAULIC DRILLING APPARATUS AND METHOD

[75] Inventors: Paul S. Turin; Robert D. Wilkes, Jr., both of Berkeley; Rowe Hakes, Bakersfield, all of Calif.

[73] Assignees: Ben Wade Oakes Dickinson, III, San Francisco; Robert Wayne Dickinson, San Rafael, both of Calif.

[21] Appl. No.: 351,244

[22] Filed: May 12, 1989

[51] Int. Cl.[5] ..... E21B 7/18; E21B 47/024

[52] U.S. Cl. ..... 175/25; 175/45; 175/67; 175/424

[58] Field of Search ..... 175/45, 67, 61, 62, 175/424, 40, 24, 25, 27

[56] References Cited

U.S. PATENT DOCUMENTS

| | | | |
|---|---|---|---|
| 3,081,828 | 3/1963 | Quick | 175/67 |
| 3,712,391 | 1/1973 | Coyne | 175/45 X |
| 3,791,042 | 2/1974 | Bell | 175/45 X |
| 4,458,766 | 7/1984 | Siegel | 175/25 |
| 4,610,321 | 9/1986 | Whaling | 175/67 X |
| 4,637,479 | 1/1987 | Leising | 175/45 X |
| 4,674,579 | 6/1987 | Geller et al. | 175/67 X |
| 4,714,118 | 12/1987 | Baker et al. | 175/45 X |
| 4,787,465 | 11/1988 | Dickinson, III et al. | 175/67 |
| 4,790,394 | 12/1988 | Dickinson, III et al. | 175/67 X |

*Primary Examiner*—Stephen J. Novosad

*Attorney, Agent, or Firm*—Flehr, Hohbach, Test, Albritton & Herbert

[57] ABSTRACT

Hydraulic drilling method and apparatus in which the drilling fluid itself is utilized to control the direction in which a hole is bored in the earth. The orientation of the drill head is monitored by tilt and roll sensors, and the discharge of drilling fluid through radially or obliquely directed nozzles is controlled by poppet valves in accordance with the orientation to control the direction in which the hole is cut.

19 Claims, 3 Drawing Sheets

HYDRAULIC DRILLING APPARATUS AND METHOD

This invention pertains generally to the drilling of boreholes in the earth, and more particularly to hydraulic drilling apparatus in which cutting is effected by streams of fluid directed against the material to be cut.

For many years, oil and gas wells have been drilled by a rotary bit mounted on a tubular drill string which extends down the borehole from the surface of the earth. The drill string is rotated at the surface, and the rotary motion is transmitted by the string to the bit at the bottom of the hole. A liquid commonly known as drilling mud is introduced through the drill string to carry cuttings produced by the bit to the surface through the annular space between the drill string and the wall of the borehole. This method of drilling has certain limitations and disadvantages. The string must be relatively heavy in order to transmit torque to the bit at the bottom of the hole. In hard rock, the drilling rate is slow, and the bit tends to wear rapidly. When the bit must be replaced or changed, the entire string must be pulled out of the hole and broken down into tubing joints as it is removed. It is necessary to use heavy, powerful machinery to handle the relatively heavy drill string. The string is relatively inflexible and difficult to negotiate around bends, and frictional contact between the string and the well casing or bore can produce wear as well as interfering with the rotation of the drill bit. Powerful equipment is also required in order to inject the drilling mud with sufficient pressure to remove cuttings from the bottom of the well.

More recently, wells and other boreholes have been drilled with small, high velocity streams or jets of fluid directed against the material to be cut. Examples of this technique are found in U.S. Pat. Nos. 4,431,069, 4,497,381, 4,501,337 and 4,527,639. In U.S. Pat. Nos. 4,431,069 and 4,501,337, the cutting jets are discharged from the distal end of a hollow pipe positioned within an reversible tube having a rollover area which is driven forward by pressurized fluid. U.S. Pat. Nos. 4,497,381 and 4,527,639 disclose hydraulic jet drill heads attached to drilling tubes which are driven forward by hydraulic pressure, with means for bending the tube to change the direction of drilling, e.g. from horizontal to vertical.

With some of the hydraulic drill heads heretofore provided, it is difficult to cut holes large enough to pass a drill string in certain materials. The larger diameter is important because the string must pass freely through the borehole for the system to operate properly. To produce a reasonably round and straight hole, the drill must cut in a symmetrical manner. In softer materials and unconsolidated formations, a non-rotating hydraulic drill head with axially directed jets may be able to cut holes several times the diameter of the drill head or spacing between the jets. However, in more indurated materials and consolidated formations, the hole cut by this drill head may not be much larger than the nozzles in the drill head itself. In some drill heads, obliquely inclined jets are employed to provide a desired cutting pattern. However, obliquely inclined jets tend to cut radial slots or grooves, rather than smooth round holes, and this problem increases as the oblique angle increases.

To produce larger holes, rotating drill heads with obliquely inclined jets have been provided. These jets may cut concentric grooves or slots and can produce holes larger than the drill head even in harder formations. Examples of such drill heads are found in U.S. Pat. Nos. 2,678,203, 3,055,442, 3,576,222, 4,031,971, 4,175,626 and 4,529,046. In most of these systems and in some non-rotating drill heads, abrasive particles are entrained in the cut to improve the cutting action. U.S. Pat. No. 4,534,427 discloses a drill head which uses a combination of hydraulic jets and hard cutting edges to cut grooves and remove material between the grooves. While rotating drill heads are capable of cutting larger holes than non-rotating drill heads in certain materials, the useful life of rotating drill heads is severely limited by bearing wear, particularly when abrasive materials are present as in most drilling operations.

U.S. Pat. Nos. 3,528,704 and 3,713,699 disclose drill heads which employ cavitation of the drilling fluid in order to increase the erosive effect of the cutting jets. These drill heads appear to have the same limitations and disadvantages as other non-rotating drill heads as far as hole size is concerned, and they are limited in depth of application.

U.S. Pat. Nos. 4,787,465 and 4,790,394 disclose hydraulic drilling apparatus in which a whirling mass of pressurized drilling fluid is discharged through a nozzle as a high velocity cutting jet in the form of a thin conical shell. The direction of the borehole is controlled by controlling the discharge of the drilling fluid, either in side jets directed radially from the distal end portion of the drill string which carries the drill head or in a plurality of forwardly facing cutting jets aimed ahead of the drill string so as to change the direction of the hole being cut. This apparatus represents a substantial improvement over the hydraulic techniques which preceded it, and it cuts very effectively both in consolidated formations and in unconsolidated formations.

It is in general an object of the invention to provide a new and improved hydraulic drilling method and apparatus in which a portion of the drilling fluid is utilized to control the direction in which a hole is bored in the earth.

Another object of the invention is to provide a hydraulic drilling method and apparatus of the above character which overcome the limitations and disadvantages of hydraulic drilling techniques of the prior art.

Another object of the invention is to provide a hydraulic drilling method and apparatus of the above character in which the drill head is economical to manufacture.

These and other objects are achieved in accordance with the invention by providing a hydraulic drilling method and apparatus in which the drilling fluid itself is utilized to control the direction in which a hole is bored in the earth. The orientation of the drill head is monitored by tilt and roll sensors, and the discharge of drilling fluid through radially directed nozzles is controlled by poppet valves in accordance with the orientation to control the position of the drill string within the borehole and, therefore, the direction in which the hole is cut into the formation.

Figure 1:
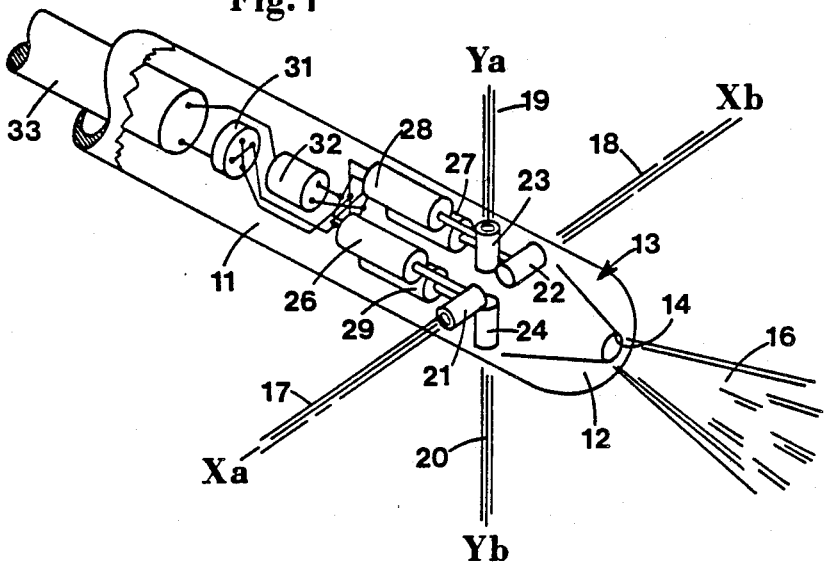
FIG. 1 is an isometric view, somewhat schematic, of one embodiment of drilling apparatus according to the invention.

As illustrated in FIG. 1, the drilling apparatus includes a tubular drill string 11 having a rounded nose or distal end 12 in which a drill head 13 is mounted. Pressurized drilling fluid is supplied to the drill head through the string and discharged through an axially facing nozzle 14 to produce a high velocity cutting jet 16. The drill head is preferably of the type disclosed in U.S. Pat. Nos. 4,787,465 and 4,790,394, and it transforms the pressurized cutting fluid into a whirling mass which is discharged in the form of a conical shell. Several embodiments of such drill heads are disclosed in the aforesaid patents, and any of these can be employed in the present invention, as can any other suitable hydraulic drill head.

The direction in which a hole is bored by cutting jet 16 is controlled by discharging a portion of the drilling fluid in radial directions in the form of steering jets 17–20 which are discharged through orthogonally aligned nozzles 21–24. The discharge of fluid through nozzles 21–24 is controlled by solenoid operated valves 26–29, respectively. As used herein, the term radial direction is used in a broad sense to include any direction to the side of the drill head, and not just perpendicular to the axis of the drill head.

Means is provided for sensing the orientation of the drill head and controlling the operation of valves 26–29 and the discharge of the steering jets accordingly. This means includes a roll sensor 31 which monitors the angular position of the drill head about the longitudinal (Z) axis of the drill string and a tilt sensor 32 which senses the orientation of the drill head about a horizontally extending (X) axis perpendicular to the longitudinal axis of the drill string. As discussed more fully hereinafter, sensors 31, 32, which can be constructed as a single unit, include switches which control the energization of the valve control solenoids from a battery pack 33 carried by the drill string.

Figure 2:
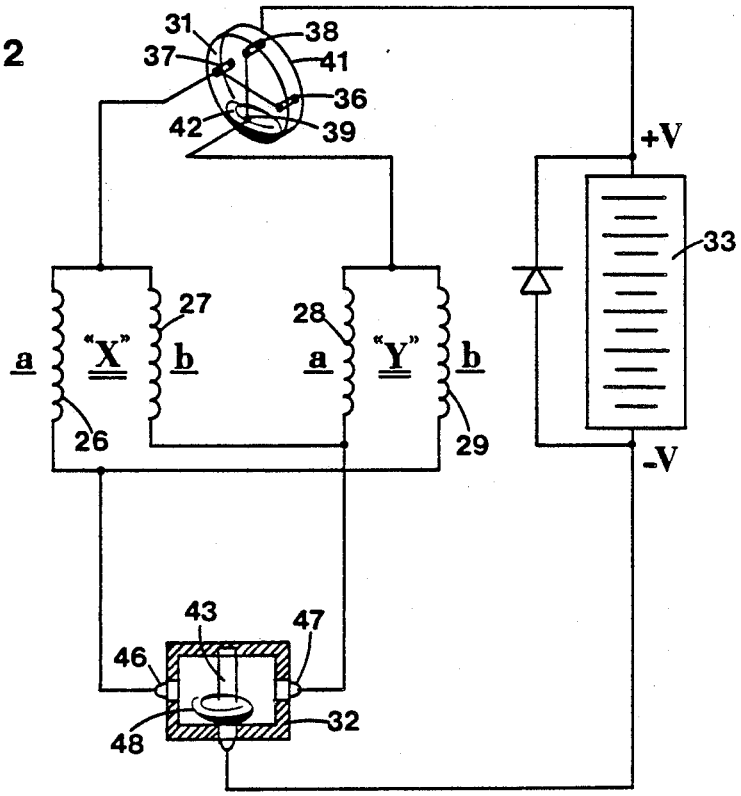
FIG. 2 is a circuit diagram of one embodiment of a control system for use in the embodiment of FIG. 1.

As illustrated in FIG. 2, roll sensor 31 has two pairs of contacts 36, 37 and 38, 39 arranged in quadrature on orthogonal axes. When the drill head is in its normal or home position, the axis on which contacts 36, 37 are aligned is horizontal, and the axis on which contacts 38, 39 are aligned is vertical. Contacts 36 and 37 are connected electrically together and to one end of solenoid coils 26, 27. Contacts 38 and 39 are connected electrically together and to one end of solenoid coils 28, 29. The roll sensor has a generally cylindrical, electrically conductive housing 41 which is connected to the positive terminal of battery pack 33. A body of mercury 42 completes an electrical circuit between the sensor housing and the contacts, depending upon the rotational or angular position of the sensor. The position of the contacts and the amount of mercury are such that one of the contacts is always in contact with the mercury and a rotation of more than about 23° in either direction about the Z-axis will bring a different contact into the mercury.

Tilt sensor 32 has a common contact 43 in the form of a ring connected to the negative terminal of the battery pack, a contact 46 connected to solenoid coils 26, 29 and a contact 47 connected to solenoid coils 27, 28. A body of mercury 48 completes an electrical circuit between the common contacts and one of the other contacts in the event that the drill head tilts in either direction from a level position.

If desired, other suitable types of roll and tilt sensors, including non-fluid sensors, can be employed in the invention place of the mercury sensors.

As long as roll sensor contacts 38, 39 remain within about 23° of the vertical axis, a circuit is completed between the positive terminal of the battery and solenoid coils 28, 29, and tilt correction is provided by jets of drilling fluid discharged through nozzles 23, 24. When the drill string rotates so that roll sensor contacts 36, 37 are within about 23° of the vertical axis, solenoid coils 26, 27 are connected to the positive terminal of the battery pack, and tilt correction is provided by nozzles 21, 22. If none of the contacts is within about 23° of the vertical axis, the lowermost two of the contacts are in contact with the mercury, and all four of the solenoids are connected to the positive terminal of the battery pack. In this situation, tilt correction is provided by the combined action of two adjacent nozzles.

If the drill string tilts from a level position, tilt sensor 32 completes the circuit to the solenoid coil(s) for the nozzle(s) which will return the drill head to a level position. Thus, for example, if the nose of the drill head should drop, contact 46 is contacted by the mercury, and either coil 26 and/or coil 29 will be energized, depending upon the rotational orientation of the drill head, to return the drill head to a level condition. Likewise, if the nose should rise, coil 27 and/or coil 28 will be energized to return the drill head to a level condition.

Figure 3:
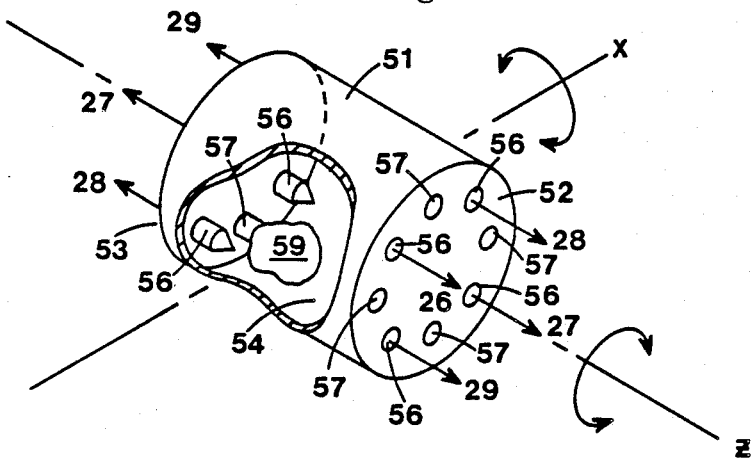
FIG. 3 is an isometric view, partly broken away, of one embodiment of a sensor for use in the embodiment of FIG. 1.

FIG. 3 illustrates a combined roll and tilt sensor which can be employed in place of the separate roll and tilt sensors in the embodiment of FIG. 1. This sensor comprises a housing having a cylindrical side wall 51, end walls 52, 53, and an internal chamber 54. Electrical contacts 56, 57 are mounted on the end walls of the housing, and a body of mercury 59 is located within the chamber to provide contact between the contacts depending upon the orientation of the sensor.

When the sensor of FIG. 3 is employed in the embodiment of FIG. 1, one end of each of the solenoid coils 26–29 is connected to one terminal of the battery pack, and the other ends of the coils are connected to the other terminal of the battery pack by contacts 56, 57 and body of mercury 59 to energize the coils as needed to maintain the drill head in a level position.

Contacts 56 are spaced in quadrature about the longitudinal axis Z and are connected to the solenoid coils, as indicated. At each end of the housing, there is one contact 56 for each of the coils, with the two contacts for each coil being positioned on opposite sides of the axis at the two ends of the sensor. Contacts 57 are positioned between the contacts for the coils and are connected to the battery terminal.

In operation, the body of mercury 59 moves to the lower end of the housing and makes contact between the lowermost two or three contacts at that end, depending upon the rotational position of the drill head about the longitudinal axis Z. Thus, for example, if the nose of the drill string should rise, with the sensor oriented as illustrated in FIG. 3, coils 26 and 28 will be energized and steering fluid will be discharged through nozzles 21 and 23 to return the drill head to a level position. If the nose should drop, coils 27 and 29 will be energized, and fluid will be discharged through nozzles 22 and 24 to return the drill head to a level position.

Figure 4:
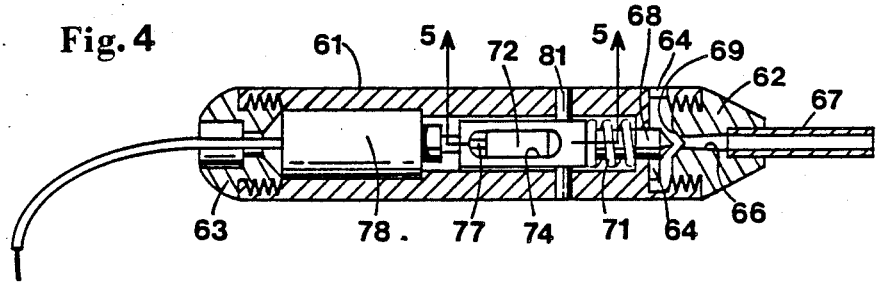
FIG. 4 is a centerline sectional view of one embodiment of a control valve for use in the embodiment of FIG. 1.
Figure 5:
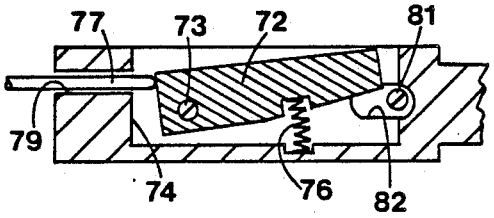
FIG. 5 is an enlarged cross sectional view taken along line 5—5 in FIG. 4.
Figure 6:
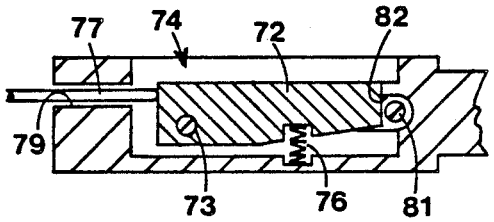
FIG. 6 is a view similar to FIG. 5 showing the apparatus in a different operational position.

FIGS. 4–6 illustrate a control valve for use in the embodiment of FIG. 1. This valve includes a cylindrical housing 61 with front and rear end plugs 62, 63. A plurality of inlet openings 64 for the drilling fluid are formed in the side wall of the housing, and a discharge nozzle 66 is formed in end plug 62. An outlet pipe 67 is affixed to end plug 62 in axial alignment with discharge nozzle 66, and this pipe can be provided with a 90° bend (not shown) to direct the discharging fluid in a radial direction.

Communication between inlet ports 64 and discharge nozzle 66 is controlled by a valve comprising an axially movable poppet member 68 and a seat 69 in end plug 62. A coil spring 71 urges the poppet member toward an open position, i.e. away from valve seat 69, and the pressurized drilling fluid urges it toward a closed or seated position.

Means is provided for selectively locking the poppet member in the open position to prevent the valve from being closed by the pressurized drilling fluid. This means includes a dog 72 which is pivotally mounted on a transversely extending pin 73 in an axially elongated cavity 74 formed in the body of the poppet member. The dog is urged toward a retracted position by a coil spring 76 and is moved to an advanced or locking position by an axially movable operating rod 77 driven by a solenoid 78. The operating rod passes through a bore 79 in the body of the poppet member and engages the rear end of the dog to pivot the dog in a clockwise direction about pin 73 as viewed in FIGS. 5 and 6. A stop pin 81 affixed to housing 61 extends through an elongated transverse bore 82 which intersects the forward portion of cavity 74 in the poppet member. This pin is in position for engagement with the front end of dog 72 to block forward movement of the poppet member when the dog is in its advanced or blocking position. When the dog is in its retracted position, it rides over the stop pin, and the poppet member is free to move toward the valve seat.

A drilling system utilizing the invention typically operates at a volume of 160 gallons per minute and a pressure on the order of 10,000 psi. When it is desired to open the valve, the pressure is reduced to a level such that spring 71 can move the poppet member away from the valve seat and solenoid 78 is energized to swing the dog into the locking position. Thereafter, when the pressure of the drilling fluid is increased, the front end of the dog abuts against stop pin 81 to prevent the valve from closing. To close the valve, the solenoid is de-energized, and the pressure of the fluid is again reduced so that the dog no longer bears against the stop pin and spring 76 can move the dog to its retracted position. Thereafter, when the pressure is once again increased, the pressurized fluid moves the poppet member forward against the valve seat, thereby closing the valve.

Figure 7:
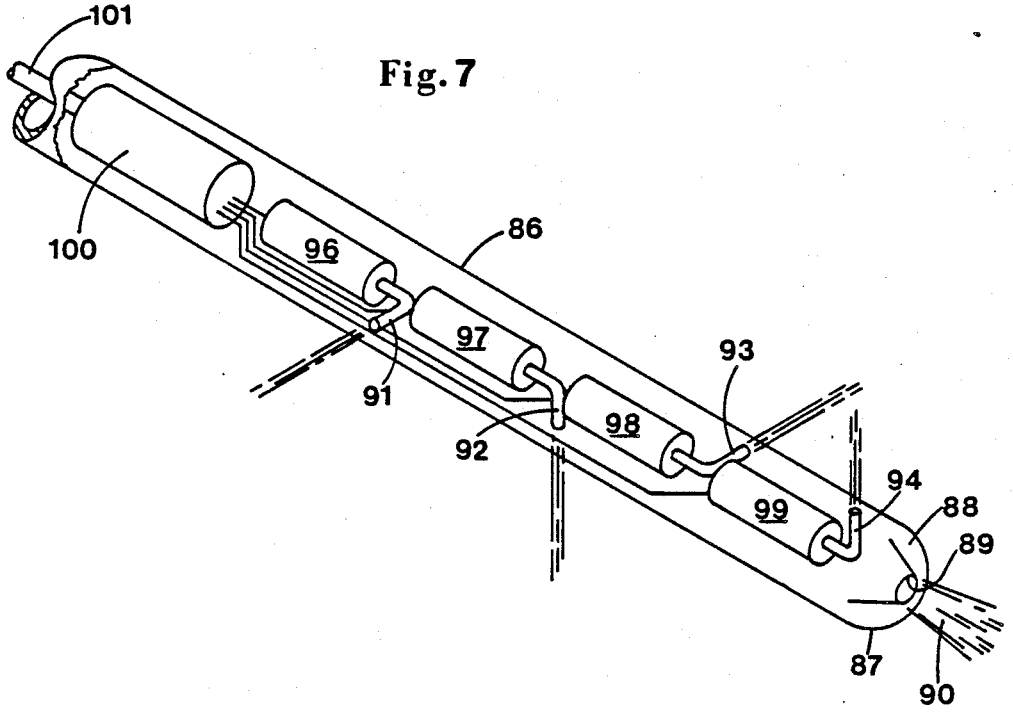
FIG. 7 is a schematic view of another embodiment of drilling apparatus according to the invention.

In the embodiment of FIG. 7, the drilling apparatus includes a tubular drill string 86 similar to drill string 11 with a rounded nose or distal end 87 in which a drill head 88 is mounted. Pressurized drilling fluid is supplied to the drill head through the string and discharged through an axially facing nozzle 89 to produce a high velocity cutting jet 90. As in the embodiment of FIG. 1, this drill head is preferably of the type disclosed in U.S. Pat. Nos. 4,787,465 and 4,790,394, and it transforms the pressurized cutting fluid into a whirling mass which is discharged in the form of a thin conical shell. Several embodiments of such drill heads are disclosed in the aforesaid patents, and any of these can be employed in this embodiment, as can any other suitable hydraulic drill head.

As in the embodiment of FIG. 1, the direction in which a hole is bored by cutting jet 90 is controlled by discharging a portion of the drilling fluid in radial directions through orthogonally aligned nozzles 91–94 to provide a side thrust which steers the drill head through the borehole. The discharge of fluid through the nozzles is controlled by solenoid operated valves 96–99 which are aligned axially within the distal end portion of the drill string. Each of the nozzles comprises an L-shaped tube which directs the discharging fluid in the desired radial direction.

The orientation of the drill head and the distal end portion of the drill string is monitored by an inclinometer or tilt and roll sensor 100 which can be similar to the sensor shown in FIG. 3. It will be understood, however, that any other suitable sensor can be employed, if desired. In this embodiment, electrical power is supplied by a cable 101 which extends through the drill string from the surface, rather than a by battery pack carried by the string.

Figure 8:
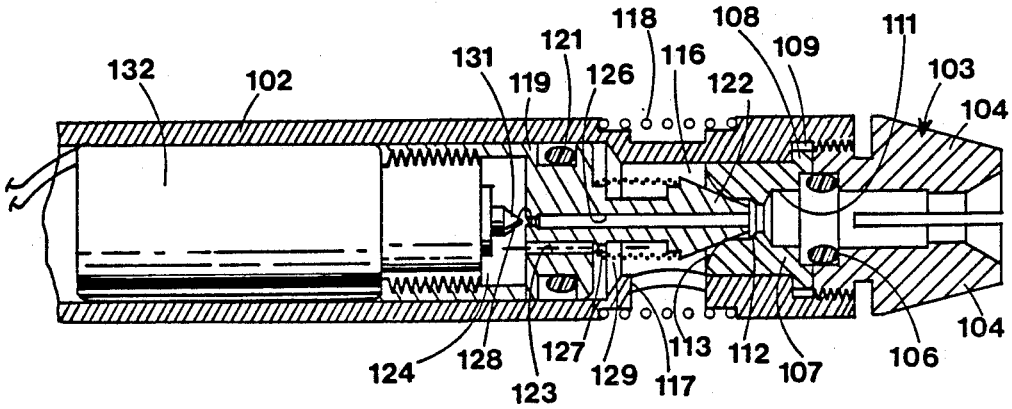
FIG. 8 is an enlarged centerline sectional view of one embodiment of a control valve for use in the embodiment of FIG. 7.

The control valve illustrated in FIG. 8 is particularly suitable for use in the embodiment of FIG. 7. This valve includes an axially elongated cylindrical housing 102 with connector 103 for the L-shaped nozzle tube threadedly mounted in the distal end portion thereof. A valve seat member 107 is also mounted in the distal end portion of the housing and secured by the connector. The nozzle tube extends through the connector, and the connector has a plurality of fingers or jaws 104 which grip the tube frictionally and retain it securely to the valve assembly. An o-ring 106 provides a fluid tight seal around the outer wall of the tube.

A valve seat member 107 is also mounted in the end portion of the housing, with a radial flange 108 clamped between the inner end of the connector and a shoulder 109 on the housing. The seat member has an axial bore 111 which receives the inner end of the nozzle tube, an axial passageway 112 which communicates with the bore, and a valve seat 113 which surrounds the passageway on the inner side on the seat member.

A chamber 116 is formed within the housing next to seat member 107, and inlet openings or ports 117 are formed in the housing wall to pass the pressurized drilling fluid from the string to the chamber. A cylindrical screen 118 is mounted in a recessed area surrounding the openings to prevent dirt and the like from entering the chamber.

An axially movable piston 119 is mounted in the housing, with the head of the piston forming one wall of chamber 116 and an o-ring 121 providing a fluid tight seal between the piston and the wall of the housing. A poppet 122 extends axially from the head of the piston for movement into and out of sealing engagement with valve seat 113 to control the discharge of pressurized fluid from chamber 116 to the nozzle. The pressurized fluid acting upon the head of the piston urges the piston away from the valve seat, and the flow of the fluid through the passageway in the seat member draws the poppet toward the seat.

Means is provided for selectively creating an imbalance in the forces acting on the piston and the poppet to cause the poppet to move into and out of engagement with the valve seat. This means includes a passageway 123 which extends between chamber 116 and a chamber 124 in the piston and a passageway 126 which extends between chamber 124 and the distal end of the poppet, with restrictive orifices 127, 128 being formed in these passageways. A cylindrical screen 129 surrounds the stem portion of the poppet and isolates the inlet of passageway 123 from chamber 116 to prevent dirt and the like from entering the passageway.

Communication between passageways 123 and 126 is controlled by a valve member 131 which can move axially into and out of sealing engagement with a seat at the inlet end of passageway 126. This valve member is urged forward into sealing engagement by a spring (not shown) and is retracted by an electrically operated solenoid 132. Electrical connections between the solenoid and the orientation sensor 101 are made through a fluid tight jack and plug assembly (not shown) at the rear of housing 102. The solenoid is threaded into the back portion of the piston, and the position of valve member 131 can be adjusted by placing annular spacers or shims (not shown) between the end of the piston and the body of the solenoid.

In operation, solenoid 132 is normally de-energized, valve member 131 is in its forward or sealing position, and poppet 122 is in sealing engagement with seat 113 to block the discharge of pressurized fluid through the nozzle controlled by the valve. In this condition, the pressure in chamber 124 builds up to a level approaching that of the pressurized drilling fluid in chamber 116, e.g. 10,000 psi. When a signal from orientation sensor 100 energizes solenoid 132, valve member 131 is retracted, and the fluid begins to pass from chamber 124 through passageway 126. As this happens, the pressure in chamber 124 begins to drop, and the balance in forces acting on the piston and poppet changes, causing the piston and poppet to move away from valve seat 113 so that the pressurized fluid can pass to the nozzle.

With valve member 131 retracted, a pressure drop occurs across restrictive orifice 127, and the pressure in chamber 124 drops to a level on the order of about one half of the pressure of the fluid in the string, e.g. to about 5,000 psi. The pressure on the face of the piston, however, remains at the higher level, and the piston remains in its retracted position with the poppet out of engagement with valve seat 113.

When the orientation of the drill head changes and the solenoid is once again de-energized, valve member 131 advances to close off passageway 126. When this happens, the pressure in chamber 124 begins to rise again toward the supply level (e.g., 10,000 psi), and the resulting change in the balance of forces causes the piston and poppet to move toward valve seat. As the poppet approaches the seat, it is drawn into sealing engagement with the seat by the flow of the fluid through to the nozzle, shutting off this flow. The poppet remains in this position until valve member 131 is once again retracted in response to a signal from the orientation sensor.

The embodiment of FIG. 8 has an advantage over the embodiment of FIG. 4 in that the valve can be opened and closed with the drilling fluid at full pressure. Thus, it is not necessary to reduce the pressure to turn the steering jet on or off as it is in the earlier embodiment. Both embodiments, however, provide a substantial improvement over systems heretofore provided for controlling the orientation and cutting direction of a hydraulic drill head.

It is apparent from the foregoing that a new and improved hydraulic drilling apparatus and method have been provided. While only certain presently preferred embodiments have been described in detail, as will be apparent to those familiar with the art, certain changes and modifications can be made without departing from the scope of the invention as defined by the following claims.

We claim:

1. In apparatus for drilling a borehole in the earth: a drill head having means for discharging a cutting jet of drilling fluid in a generally axial direction to form the borehole, means for supplying pressurized drilling fluid to the drill head, a radially directed nozzle for discharging a portion of the drilling fluid in a radial direction to control the position of the drill head within the borehole, means for sensing the orientation of the drill head, and valve means responsive to the sensing means for controlling delivery of the fluid to the radially directed nozzle.

2. The apparatus of claim 1 wherein the drill head is carried by an axially elongated drill string, and the means for sensing the orientation of the drill head includes means for sensing orientation of the head about an axis perpendicular to the axis of the drill string.

3. The apparatus of claim 1 wherein the means for sensing the orientation of the drill head includes means for sensing orientation about the axis of the drill head.

4. The apparatus of claim 1 wherein the means for sensing the orientation of the drill head includes a first and second sets of electrical contacts spaced apart along the axis of the drill head, and an electrically conductive fluid material which can contact the contacts in either set to form an electrical circuit between them in accordance with the orientation of the drill head about a horizontal axis.

5. The apparatus of claim 4 wherein each of the sets of contacts includes a plurality of contacts spaced about the axis of the drill head, the electrically conductive material forming a circuit between different ones of the contacts depending upon the orientation of the drill head about its axis.

6. The apparatus of claim 1 wherein the valve means includes a valve seat, a poppet movable between open and closed positions relative to the valve sea for controlling the delivery of fluid to the nozzle, a dog pivotally connected to the poppet for movement between first and second positions, said dog in the first position being engagable with a stop to prevent movement of the poppet to the closed position, and an operator for moving the dog to the first position.

7. The apparatus of claim 1 wherein the valve means includes a valve seat through which the drilling fluid is delivered to the nozzle, a poppet carried by a piston for movement toward and away from the valve seat to control the delivery of fluid to the nozzle, the pressurized fluid acting against one side of the piston to urge the poppet away from the valve seat and the flow of fluid through the valve seat tending to draw the poppet toward the valve seat, a control passageway exposed at one end to the pressurized fluid and extending through the poppet to communicate with the nozzle when the poppet is seated against the valve seat, and means responsive to the sensing means for controlling communication through the passageway to control the position of the poppet relative to the valve seat.

8. In drilling apparatus in which a cutting jet of drilling fluid is discharged in a generally axial direction to form a borehole and a portion of the drilling fluid is discharged through a nozzle to control the direction in which the hole is cut: a valve seat, a poppet movable between open and closed positions relative to the valve seat for controlling the delivery of fluid to the nozzle, a stop member mounted in a stationary position relative to the valve seat, a dog pivotally connected to the poppet for movement between first and second positions, said dog in the first position being engagable with the stop member to prevent movement of the poppet to the closed position, and an operator for moving the dog to the first position.

9. In drilling apparatus in which a cutting jet of drilling fluid is discharged in a generally axial direction to form a borehole and a portion of the drilling fluid is discharged through a nozzle to control the direction in which the hole is cut: an elongated valve body having an axial bore, a valve seat positioned toward one end of the bore, a poppet mounted within the axial bore for movement toward and away from the valve seat to control the delivery of fluid to the nozzle, resilient means yieldably urging the poppet away from the valve seat, a transverse bore in the poppet, a pin extending transversely of the bore in the valve body and passing through the transverse bore in the poppet to limit movement of the poppet away from the valve seat, an axially elongated cavity in the poppet which intersects the transverse bore, a dog pivotally mounted in the cavity for movement into and out of position for engagement with the pin to prevent movement of the poppet toward the valve seat, and an operator for moving the dog into position for engagement with the pin.

10. The apparatus of claim 9 wherein the operator comprises an electrically energizable solenoid and an axially movable rod actuated by the solenoid for engagement with the dog to pivot the dog into position for engagement with the pin.

11. In apparatus for drilling a borehole in the earth: a drill head having means for discharging a cutting jet of drilling fluid in a first direction to form the borehole, means for supplying pressurized drilling fluid to the drill head, a nozzle for discharging a portion of the drilling fluid in a second direction to control the orientation of the drill head within the borehole, a valve seat through which the drilling fluid is delivered to the nozzle, a poppet carried by a piston for movement toward and away from the valve seat to control the delivery of fluid to the nozzle, the pressurized fluid acting against one side of the piston to urge the poppet away from the valve seat and the flow of fluid through the valve seat tending to draw the poppet toward the valve seat, a control passageway exposed at one end to the pressurized fluid and extending through the poppet to communicate with the nozzle when the poppet is seated against the valve seat, and means responsive to the orientation of the drill head for controlling communication through the passageway to control the position of the poppet relative to the valve seat.

12. The drilling apparatus of claim 11 wherein the means for controlling communication through the passageway includes a solenoid operated valve.

13. In apparatus for drilling a borehole in the earth: a drill head having means for discharging a cutting jet of drilling fluid in a first direction to form the borehole, means for supplying pressurized drilling fluid to the drill head, a nozzle for discharging a portion of the drilling fluid in a second direction to control the orientation of the drill head within the borehole, and a valve assembly for controlling delivery of the drilling fluid to the nozzle, said valve assembly comprising an axially extending housing, an axially movable piston within the housing, a valve seat toward one end of the housing an outlet communicating with the nozzle, a chamber in the housing between the piston and the valve seat which is exposed to the pressurized fluid, a poppet carried by the piston for movement into and out of sealing engagement with the valve seat, a control chamber within the piston, a first passageway extending between the housing chamber and the control chamber, a second passageway extending axially from the control chamber through the poppet, and valve means within the control chamber for controlling communication between the first and second passageways.

14. The drilling apparatus of claim 13 wherein the valve means comprises an axially movable valve member movable between open and closed positions relative to second passageway, and an electrically operated solenoid for moving the valve member toward one of said positions when actuated.

15. In a method of drilling a borehole in the earth, the steps of: supplying pressurized drilling fluid to a drill head, discharging a cutting jet of the drilling fluid in a first direction to form the borehole, discharging a portion of the drilling fluid through an orifice controlled by a poppet valve in a second direction to control the orientation of the drill head within the borehole, providing an electrical signal corresponding to the orientation of the drill head relative to a horizontal axis, and controlling the operation of a poppet valve in response to the electrical signal.

16. The method of claim 15 wherein the electrical signal is provided by completing an electrical circuit between electrical contacts with an electrically conductive material which is movable relative to the contacts in accordance with the orientation of the drill head.

17. The method of claim 15 including the steps of delivering the fluid to the controlled orifice through a valve seat, moving a poppet member into and out of sealing engagement with the valve seat to control the discharge of fluid through the orifice, the poppet member being urged toward engagement with the valve seat by the pressurized fluid, and selectively engaging and disengaging a stop to control movement of the poppet member toward the valve seat.

18. The method of claim 15 including the steps of delivering the fluid to the controlled orifice through a valve seat, moving a poppet member into and out of sealing engagement with the valve seat to control the discharge of fluid through the orifice, the poppet member being urged away from the valve seat with a first force by the pressurized fluid and being drawn toward the seat with a second force by the flow of fluid through the orifice, and creating an imbalance in the forces to cause the poppet member to move either into or out of engagement with the valve seat in accordance with the orientation of the drill head.

19. The method of claim 15 wherein the imbalance in the forces is created by bleeding a portion of the high pressure fluid through a passageway in the poppet member.

* * * * *